US005111875A

United States Patent [19]

Hammarstedt

[11] Patent Number: 5,111,875

[45] Date of Patent: May 12, 1992

[54] MODULAR HEAT INSTALLATION FOR PREMISES WITH WATER AS A HEAT TRANSMITTING MEDIUM

[76] Inventor: Curt Hammarstedt, Nygatan 6, S-360 75 Alstermo, Sweden

[21] Appl. No.: 548,981

[22] PCT Filed: Feb. 6, 1989

[86] PCT No.: PCT/SE89/00045

§ 371 Date: Aug. 1, 1990

§ 102(e) Date: Aug. 1, 1990

[87] PCT Pub. No.: WO89/07224

PCT Pub. Date: Aug. 10, 1989

[30] Foreign Application Priority Data

Feb. 5. 1988 [DE] Fed. Rep. of Germany ... 8801457[U]

[51] Int. Cl.[5] ..... F24D 3/00; F24D 19/00; F28D 1/03; F28F 9/26

[52] U.S. Cl. ..... 165/50; 165/53; 165/56; 165/137; 237/56

[58] Field of Search ..... 165/50, 53, 56, 57, 165/49, 137; 237/8 R, 56

[56] References Cited

U.S. PATENT DOCUMENTS

| | | | |
|---|---|---|---|
| 1,663,271 | 3/1928 | Kehm | 237/56 |
| 1,770,813 | 7/1930 | Selzer | 165/56 |
| 2,072,427 | 3/1937 | O'Brien | 165/50 |
| 2,113,775 | 4/1938 | Vulpern | 165/57 |
| 2,486,141 | 10/1949 | Follo | 237/56 |
| 2,500,642 | 3/1950 | Morse et al. | 237/56 |
| 2,573,539 | 10/1951 | Bryce | 165/53 |
| 2,835,186 | 5/1958 | Goldsmith | 165/53 |
| 4,653,573 | 3/1987 | Hansen | 237/56 |

FOREIGN PATENT DOCUMENTS

| | | | |
|---|---|---|---|
| 0008544 | 3/1980 | European Pat. Off. . | |
| 1454372 | 1/1969 | Fed. Rep. of Germany | 237/56 |
| 1775636 | 9/1971 | Fed. Rep. of Germany . | |
| 2635903 | 2/1978 | Fed. Rep. of Germany . | |
| 2705117 | 8/1978 | Fed. Rep. of Germany . | |
| 2723556 | 11/1978 | Fed. Rep. of Germany . | |
| 2843818 | 4/1980 | Fed. Rep. of Germany | 165/53 |
| 2920472 | 11/1980 | Fed. Rep. of Germany | 165/56 |
| 3533460 | 3/1987 | Fed. Rep. of Germany | 237/56 |
| 1537724 | 8/1968 | France | 237/56 |
| 2320507 | 3/1977 | France | 165/53 |
| 436446 | 12/1984 | Sweden . | |

*Primary Examiner*—John K. Ford
*Attorney, Agent, or Firm*—Davis, Bujold & Streck

[57] ABSTRACT

A heat installation for buildings, with water as the heat transmitting medium which comprises a forward pipe and a return pipe (19 and 18 respectively) as well as radiators (11) connected to said pipes. Said installation is designed as a building element system and comprises differently designed buildings elements (1-10), which are strip- and block-shaped and can be inserted into each other and with which said forward pipe and said return pipe are integral parts. Said installation includes a main connection element (1), connection elements (2), inner corner and outer corner elements (3 and 4 respectively), threshold transition elements (5, 7), thresholds (6), radiator connection elements (8) and terminal parts (9). In a radiator connection element (8), like in the majority of the remaining elements, said pipes are arranged the one above the other, and through said element cylindrical cuts (51) extend, at right angles with said pipes, within the plane of said pipes and at a distance from each other in a horizontal direction, in which cuts inserts (54 and 55 respectively) can be introduced, one insert type (54) being designed for a one-pipe system and one of the radiator connection elements as regards said two-pipe-system respectively, while the other insert type is designed for a two-pipe-operation having a casing-like constriction element (66), which crosses the adjacent pipe (19) and ends in the other pipe (18). Said insert types can optionally be introduced into said cuts in order to allow a one-or-two pipe operation, also within the same installation.

19 Claims, 6 Drawing Sheets

MODULAR HEAT INSTALLATION FOR PREMISES WITH WATER AS A HEAT TRANSMITTING MEDIUM

Figure 1:
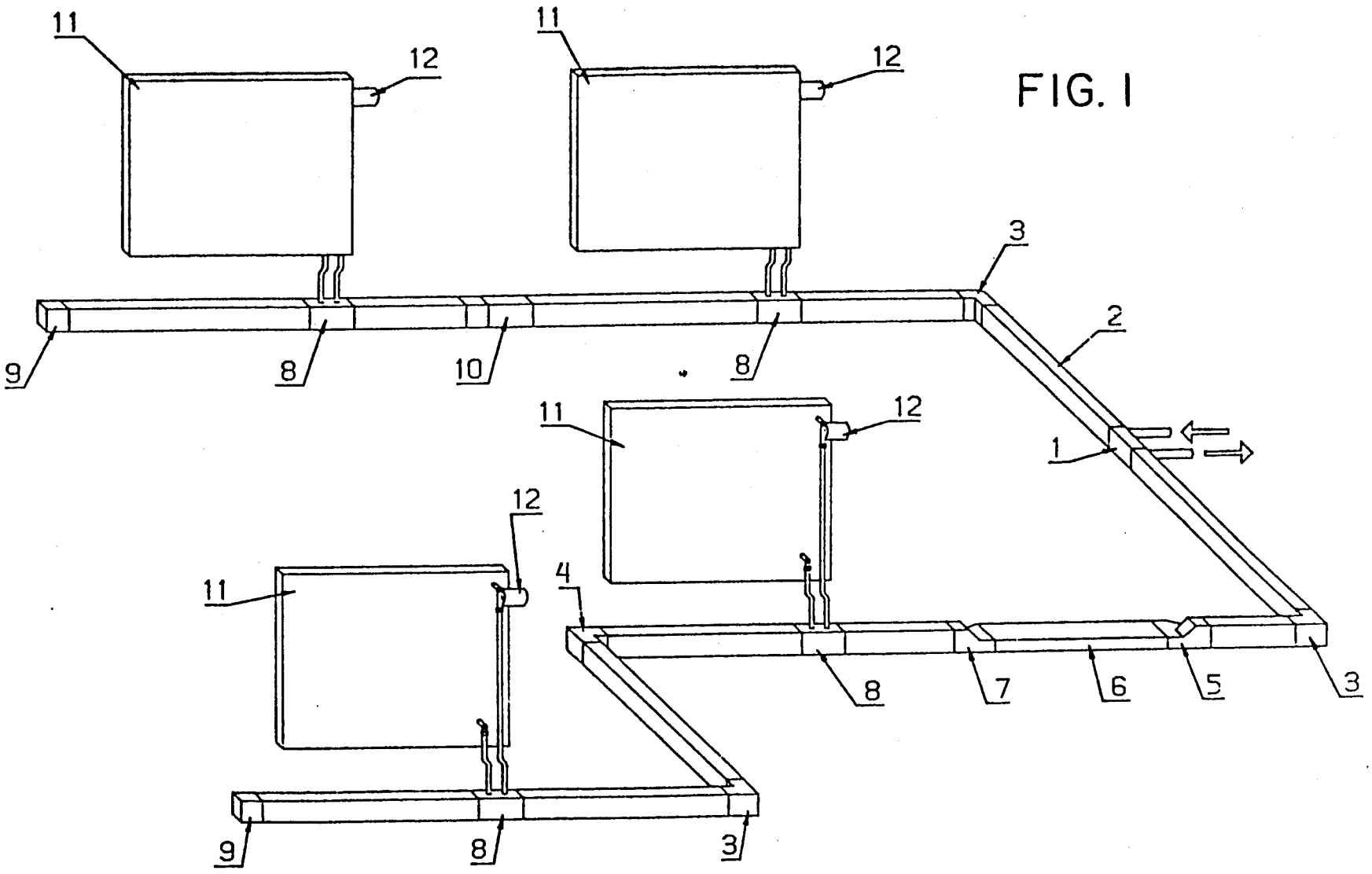

The present invention relates to a heat installation for premises, water being used as a heat transmitting medium.

Such conventional heat installations comprise loosely layed visible piping or piping accommodated in walls and floors respectively. Said installations are designed throughout either as one- or as two-pipe-systems. In all of the cases the installation has been performed by artisans with a manual individual pipe laying and assembly operation, which is very expensive and time-consuming. In case such a system is to be installed in already finished houses, usually it is required that the floors and walls be torn open for an invisible pipe laying, or if the pipe laying is to be visible, said pipes will constitute a strongly disturbing factor and also usually will emit heat in places where heat is not required, which to some extent is true as regards pipe laying in walls and floors, in which the heat insulation is unsatisfactory. Invisible pipe laying may involve risk of leakage, which is hard to discover, with severe damages as a result, when leakage has been discovered after usually an extended period of time, and the development of mould, rot and rust. Irrespective of whether an installation is done in connection with the erection of a building or in an already finished building painters, carpenters, floor-layers etc. have so far been required to be able to complete their work or else they were required to perform additional work, when the installation contractors have completed their work. The problem whether to select an one-pipe- or a two-pipe-system has also often been difficult to solve. One of the two systems may have been suitable for e.g. one specific module or building element, while the other one had been suitable for other modules. However, for practical reasons it has been necessary to consistently select one single system and thus, one has been unable to combine the two systems in a way which is advantageous for a partial area. To let laymen install the heat system has been inconceivable and in certain countries not allowed, partly due to the above-mentioned drawbacks and risks.

The object of the present invention is to suggest an improved heat installation, in which water is used as a heat transmission medium and which avoids the drawbacks mentioned above and promotes the state of the art in this field in various respects.

This object is attained by mainly designing an installation of the type set forth above. Thanks to such a design it is very easy to use such a system as a so called do-it-yourself installation, i.e. an installation done by laymen, e.g. home and apartment owners. This system can easily be delivered as a module system suitable for all conceivable sizes, designs and applications. Those buildings, in which the system is to be installed, advantageously can be completed, i.e. finish-painted and upholstered, provided with floor covering etc. before the system according to the invention is to be installed. This means that the system according to the invention advantageously can be installed in new as well as in old buildings. When so called prefabricated houses are erected, it is not necessary to pay attention to the pipe laying and wall and floor elements can be provided even more finished than what has been possible in certain cases so far. All kinds of pre-layout in this respect can be avoided and the house or apartment owner can himself to a great extent select the design of the system or change the same subsequently without any appreciable problems. Consequently, e.g. houses having electrical heat elements, which act directly, can in a quick, simple and inexpensive way be provided with a heat installation :according to the present invention with water as a heat transmitting medium. Also, an installation according to the present invention does not require any closed so called loops. Thus, parts of the system advantageously can be installed as branches, which are terminated in optional areas. In this way it is e.g. possible, in the way shown in FIG. 1 of the accompanying drawings, to lay one branch along one portion of a building, while another branch provides another portion of the building with heat. Then said one branch can be designed as an one-pipe-system and the other branch as a two-pipe-system, and in this way different heating requirements can be met in an optimal manner. The production of the various components, which the system includes, can be done in simple, fast and inexpensive ways due to a large scale production, e.g. through casting or injecting molding of metallic and plastic materials respectively, starting with uniform modules for radiator connection elements, which subsequently can be easily and specifically adapted for e.g. one- or two-pipe-operation and having varying choking/heat emission capacities respectively. In this way it is easy to install radiators having an arbitrary size/heat emission capacity in arbitrarily selected areas and, if that is required, at the same time select an adequate circulation of the heat medium through the radiator. This installation can easily be designed to smoothly and in principle without problems be passed by a door opening in a way that is set forth in the following description and the accompanying drawings, such an installation section preferably being designed as a threshold. It is then possible, in case this is required in a particular case, to without problems obtain a reversal of the pipes, i.e. to let the forward and return pipes change places, the upper pipe on one side of the door opening becoming the bottom pipe on the other side. All the components in the installation can be designed to emit heat in an adequate manner, i.e. exactly with the heat emission and heat insulation which is required. This means e.g., that normally one tries to avoid a heat emission/heat losses, but that one, in order to avoid or counteract e.g. cold waves (kallras) below windows and along exterior walls, designs said components to emit more heat by using less or no heat insulating material or by using additional heat emitting elements, which are known per se, e.g. ribs, circulation openings etc. It is true that the building itself, in which the system is to be installed, can be completed and finished, when the system is to be installed, but the system itself and all the components included in it can of course be completed and finished, e.g. painted, anodized etc. Any other tools than e.g. an adjustable wrench and a screw driver will not be required. It is sufficient that the so called mains have been extended to a certain point, from which the system then can be installed, without requiring any expert work.

Figure 2A:
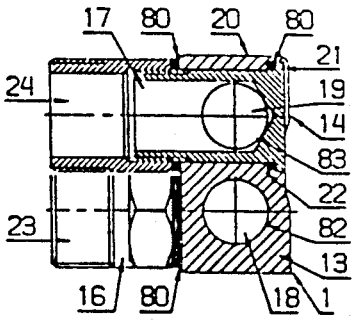
Figure 2B:
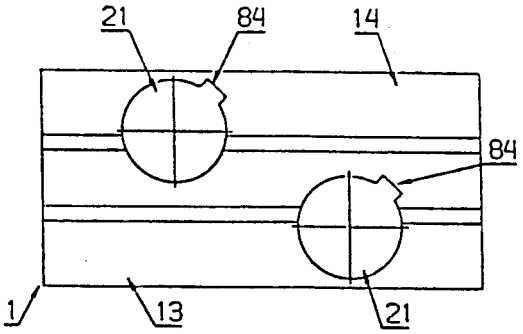
Figure 2C:
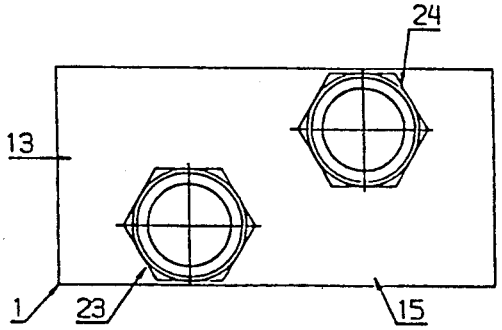
Figure 3A:
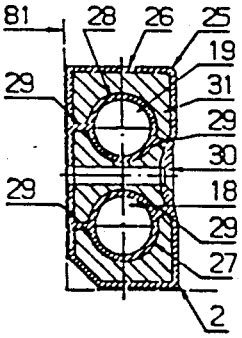
Figure 4A:
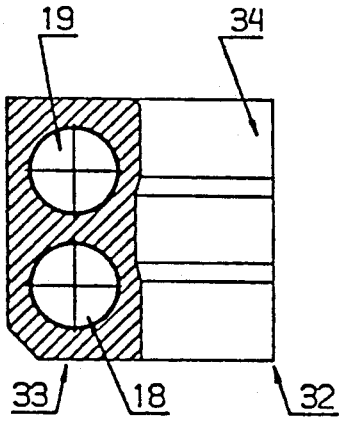
Figure 4B:
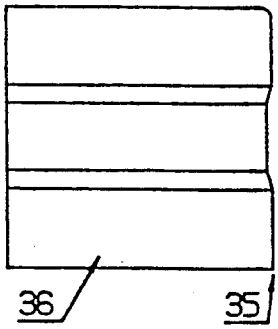
Figure 4C:
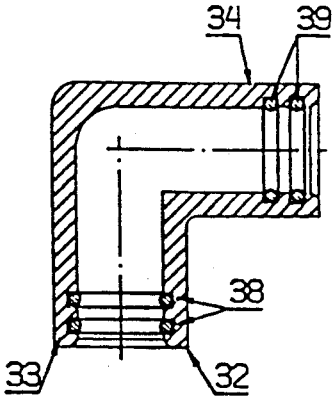
Figure 4D:
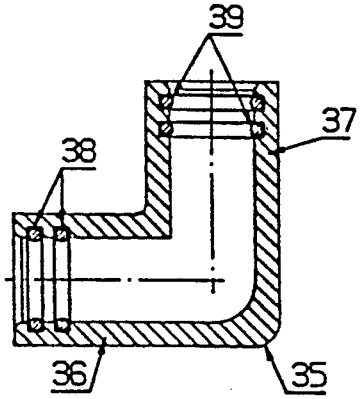
Figure 8A:
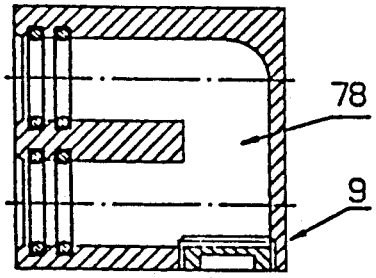
Figure 8B:
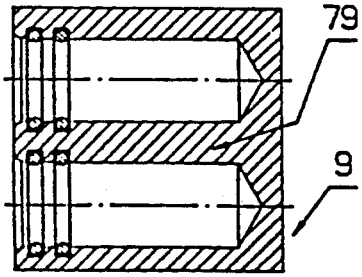
Figure 5E:
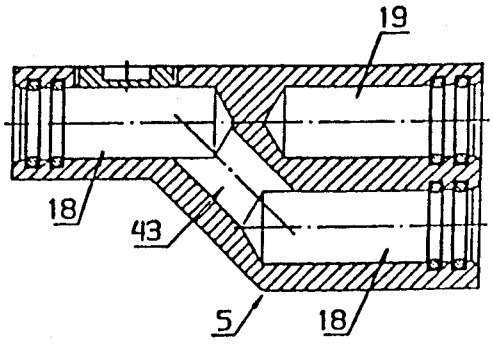
Figure 5F:
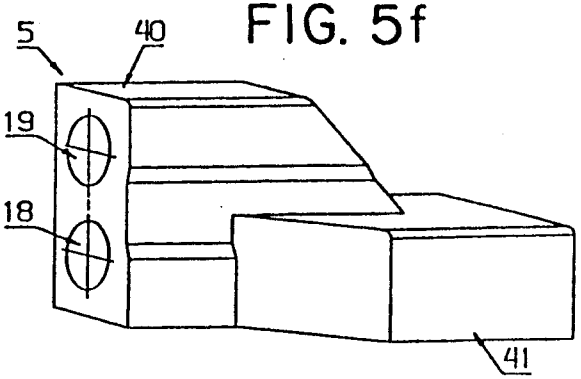
Figure 5C:
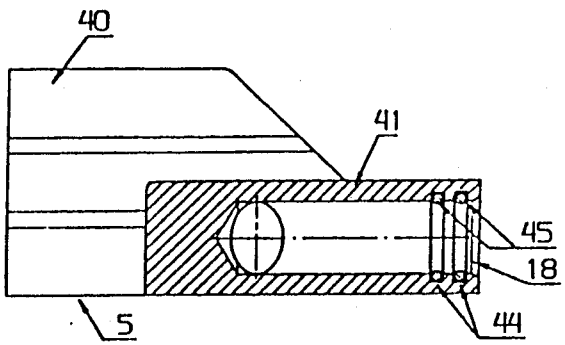
Figure 5D:
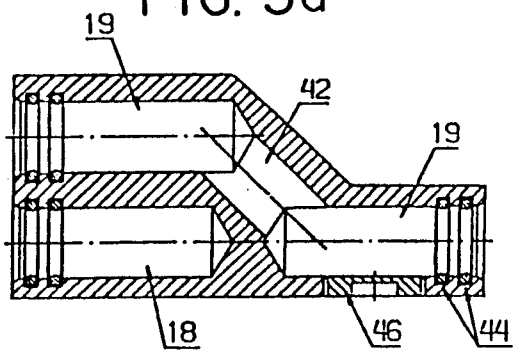
Figure 5A:
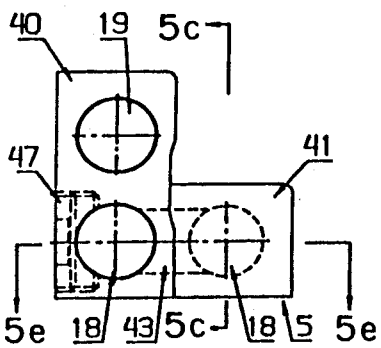
Figure 5B:
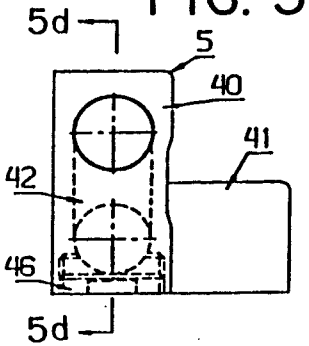
Figures 6A, 6B, 6C, 6D, 6E:
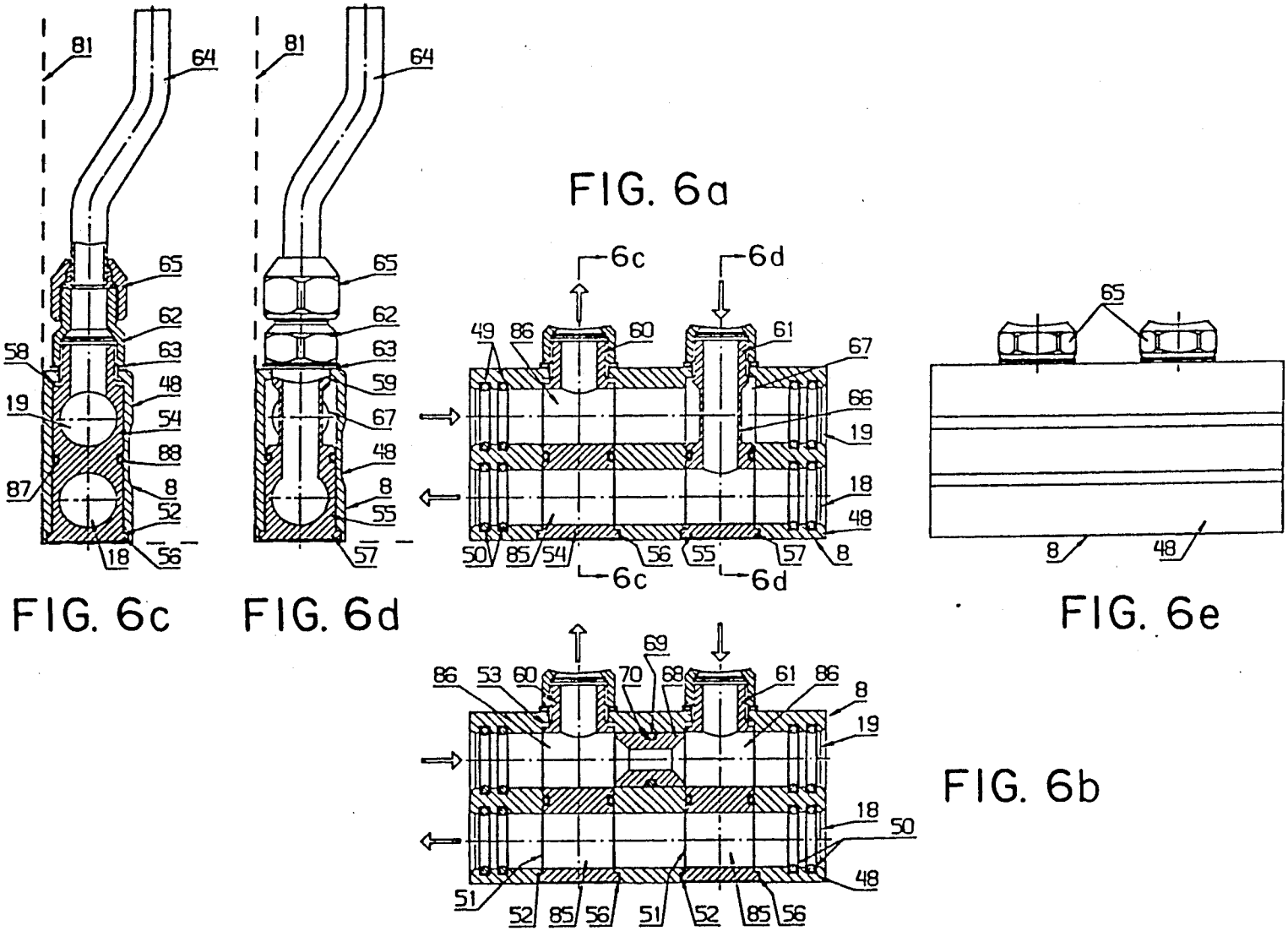
Figure 7B:
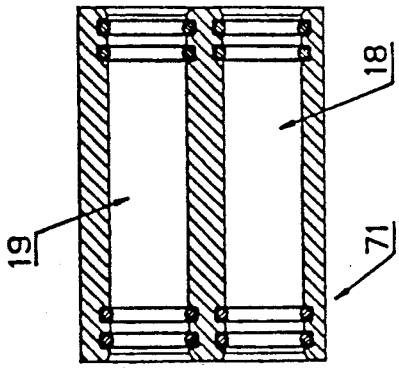
Figure 7C:
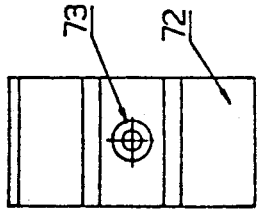
Figure 7D:
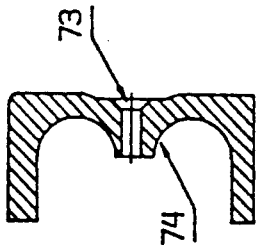
Figure 7A:
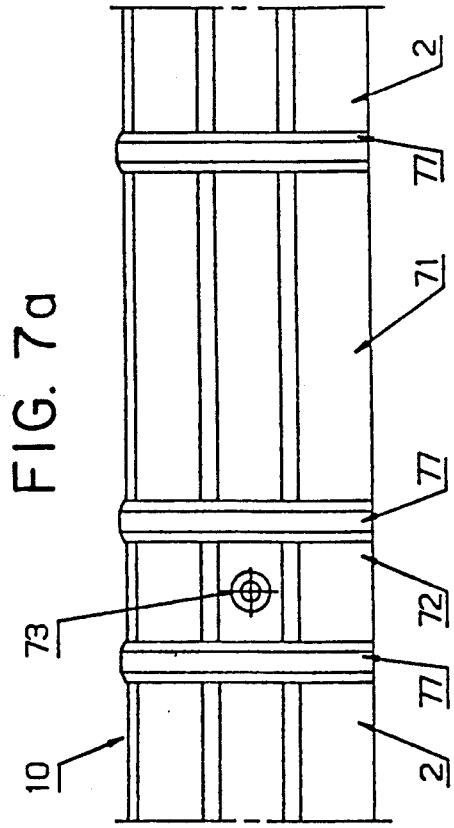
Figure 7F:
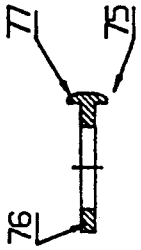
Figure 7E:
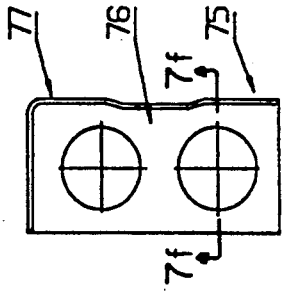

Additional characterizing features and advantages of the invention are set forth in the following description, reference being made to the drawings, in which preferred although not limiting embodiments are shown and which include in more detail and partly schematically:

FIG. 1 a perspective view of a heat installation according to the present invention using water to transmit heat; FIG. 2 a main connection element (1) according to FIG. 1, shown in a) a sectional view, b) from the left and c) from the right in FIG. 1 FIG. 3 a connection element (2) according to FIG. 1, shown a) in a lateral or gable view and b) in a view from the FIG. 2*a* is partial cross-sectional view of a main connection element according to FIG. 1. FIG. 2*b* is a front elevational view of the main connection element, and FIG. 2*c* is a rear elevational view of the main connection element;

FIG. 3*a* is a cross-section view of a connection element and FIG. 3 is a front elevational view of the connection element;

FIG. 4*a* is a partial cross-sectional view of an inner-corner element, FIG. 4*b* is an end view of an outer corner element, and FIG. 4*c* and FIG. 4*d* show cross-sectional views of FIG. 4*a* and 4*b*, respectively;

FIGS. 4*a* and 5*b* show similar end views of a threshold transition element, FIG. 5*c* is a sectional view along line 5*c* —5*c* of FIG. 5*a*. FIG. 5*d* is a sectional view along line 5*d*—5*d* of FIG. 5*b* FIG. 5*e* is a sectional along 5*e*—5*e* of FIG. 5*a* and FIG. 5*f* is a perspective view of the threshold transition element;

FIG. 6*a* is a cross-sectional view of a first embodiment of a radiator connection element, FIG. 6*b* is a cross-sectional view of a second embodiment of a radiator connection element, FIG. 6*c* is a cross-sectional view along section line 6*c*-6*c* of FIG. 6*a* showing the connection of a radiator connection element, FIG. 6*d* is a cross-sectional view along section line 6*d*—6*d* of FIG. 6*a* showing the connection of a radiator connection element, and FIG. 6*e* is a front elevational view of the radiator connection element;

FIG. 7*a* is a front elevational view of a joint element showing its use, FIG. 7*b* is a cross-sectional view of the joint element, FIG. 7*c* is a front elevational view of a distant element, FIG. 7*d*, is a left end elevational view of the distant element of FIG. 7*c*, FIG. 7*e* is an end view of a cover element to spand the joints and FIG. 7*f* is a cross-sectional view of the cover element along section line 7*f*—7*f* of FIG. 7*e*;

FIG. 8*a* is a cross-sectional view of a terminal part for a one pipe system and FIG. 8*b* is a cross-sectional view of a terminal part for a two pipe system.

In FIG. 1 a main connection element 1 is shown, which in a way known per se is designed to be connected to main pipings (not shown) to and from e.g. a central heater (not shown) and which is shown in more detail in FIG. 2. In FIG. 3 connection elements 2 are shown in more detail and in FIG. 4 inner corner elements 3 and outer corner elements 4 respectively are shown. Threshold transition elements 5 and 7 are mirror-symmetrically alike. Element 5 is shown in detail in FIG. 5. A threshold 6 is disposed between such threshold transition elements. A radiator connection element 8 is shown in detail in FIG. 6. Terminal parts 9 for blind loop ends are shown and in FIG. 7 a joint element 10 is shown in detail, while in FIG. 1 radiators 11 are shown, which can be conventional hot water radiators having conventional radiator valves 12.

The heat installation shown in FIG. 1 is provided with two blind branches, it being easy to design each branch, thanks to the characterizing features of the present invention, according to individual needs at any time for an one-pipe-operation or a two-pipe-operation. It is easy to design e.g. one of the branches for one-pipe-operation and the other for two-pipe-operation, there being no need to make any exterior alterations. It is also possible, at any time, to add to the branches, i.e. extend them and/or mutually connect their ends. Also, it is easy to later on connect additional radiators and to remove existing radiators respectively from the system.

FIG. 1 shows clearly, that a heat installation according to the invention advantageously can be designed as a basic module system or building element system, selling the various components advantageously being done in self-service outlets and an installation subsequently being done by the buyer himself, e.g. a home or an apartment owner. It is true that the majority of the components can be delivered in one single standard design as to dimensions, but it is easy to provide connection elements 2 and thresholds 6 in various lengths, it thereby being easy and simple to accommodate signs, particularly because the exact location of the various components per se easily can be adjusted within certain limits thanks to the insertion principle and the relative displaceability together with maintained functions for the rest which result from it.

Main connection element 1 shown in FIG. 2 comprises an arbitrarily designed strip- or block-shaped shell 13( which can be solid or hollow and be made of a plastic and/or metallic material having a front or room side 14 and a rear or connection side 15, from which connection pieces 16,17 project, which are placed on different levels and which are connected at right angles to one return pipe and one forward (supply) pipe respectively namely pipe 18 and pipe 19 respectively, which extend through the main connection element in its longitudinal direction. Pipes 18,19 are usually open in both directions, but in case just one branch is to issue from said main connection element, one of the end openings of pipes 18,19 can be closed, e.g. plugged up. Front side 14 and upper side 20 of the main connection element can be decoratively designed in an arbitrary way, suitably in the same way and with the same profile dimensions as the following components, which are included in the installation. Pipe 18 is of course the feed pipe for hot water and pipe 19 the return pipe for colder water. The upper pipe is e.g. the feed pipe. Main connection pieces 16,17 advantageously can comprise essentially tubular through elements (see FIG. 2*a*), which extend through transverse cuts (bores) in shell 13 and engage with closed ends having flanges 21 in a somewhat broader recess 22 on the room-side of the shell, nipples 23 and 24 respectively being secured on ends, which project from the rear side of said pieces and e.g. are provided with external threads and which allow pieces 16,17 to be sealed against the shell, intermediate seals or the like being used. To this end those parts of the nipples which are placed adjacent the shell can e.g. have a hexagonal shape (see FIG. 2*c*). Within the area of pipes 18,19 said pieces have transverse openings 82 and 83 respectively which correspond to the pipes, and location notches 84 of some type, which prevent a rotation, can of course also be provided in an optional place. The terminal areas of pipes 18,19 are, in a way which is shown in FIG. 4 and so forth, provided with circumferential internal grooves (not shown) and 0-rings or the like introduced into said grooves.

Figure 3B:
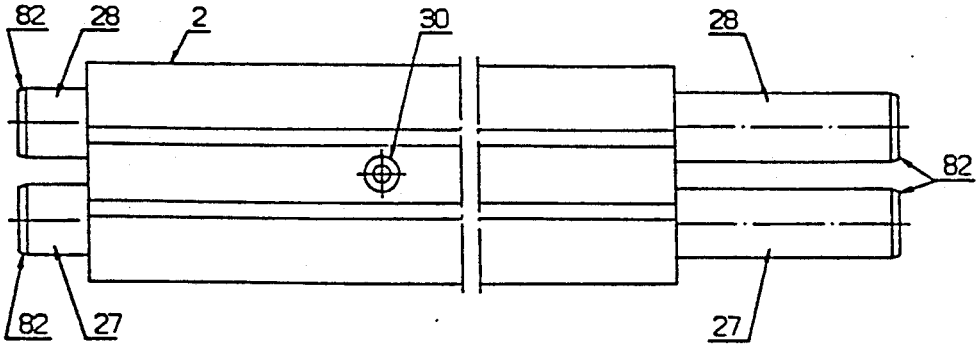

Connection element 2, shown in FIG. 3, comprises a shell 25 comprising e.g. a closed external housing 26, which accommodates ducts 27,28, one disposed above the other, which are designed to function as a return pipe and a forward pipe respectively and which project beyond the two ends of the shell in its longitudinal direction, e.g. different distances at the two sides, as shown in FIG. 3*b*, at least as regards elements adjacent a joint element to be described subsequently. Ducts 27,28 can be integral with shell 25 by means of bridge portions 29 according to FIG. 3*a*. Also, said shell can be provided with central transverse control elements 30 designed as holes and/or casings for screws or the like, by means of which said elements can be fastened to e.g. a wall 81. Possibly with the exception of said control elements 30 such a connection element can be made all of a piece, of a plastic and/or metallic material, e.g. aluminum, and remaining cavities can advantageously be filled with an insulating material 31 in a way known per se as regards the method. Also, ducts 27,28 according to FIG. 3*a* can be designed solely as control elements, which possibly are not through elements in their longitudinal direction and/or their circumferential direction, for separately introduced ducts, which possibly subsequently can be fastened to the shells, if that is desirable. In this way it is easier to cut the connection elements to suitable lengths, without introduced ducts, on the installation site, and ducts having the correct lengths can be introduced into said shells and in this way a not desirable cutting of the ducts can be avoided. The duct ends are provided with circumferential external bevellings 82.

In FIGS. 4*a* and 4*c* an inner corner element 32 is shown, legs 33,34 of which suitably having the same external profile as said connection elements and said main connection element. An outer corner element 35 according to FIGS. 4*b* and 4*d* is designed in a similar fashion having legs 36 and 37 and the only difference between the two elements is that the room side, i.e. the possibly decorated side, in one of the cases is an inner corner and in the other case an outer corner. In the two cases pipes 18,19 are disposed one above the other and their ends are provided with circumferential grooves 38, in which O-rings or the like 39 are introduced. Such corner elements are connected in a simple way to adjacent connection elements, the projecting duct ends of the latter being inserted in legs at least such a distance, that O-rings or the like 39 are passed and in this way are expanded and consequently seal. Said corner elements can also be made in one piece of a plastic and/or a metallic material. They can be made hollow according to FIG. 3*a* or possibly solid.

Threshold transition element 5, shown in FIG. 5, corresponds mirror-symmetrically to threshold transition element 7, and thus the latter will not be shown or described in more detail. It is shown that element 5 has an upended (first) portion 40, similar to the components described above and which changes into a horizontal (second) portion 41. The latter portion suitably is, as regards the external profile, similar to threshold 6, and in this way an adaptation to various threshold profiles can easily be done. It is shown in the various views in FIG. 5 that upper pipe 19 changes via an obliquely downwardly directed passage 42 into a lower extension of the same pipe, while lower pipe 18 via a passage 43, in an obliquely lateral direction, changes into a laterally shifted extension of the same pipe. FIG. 5*e* shows that the two pipes 18,19 are disposed within the horizontal threshold transition portion 41 adjacent each other in the same horizontal plane. The same pipe orientation is used within threshold 6, not shown in detail, which then is connected to the mirror-symmetrically designed threshold transition element 7, in which pipe 19 again being disposed on top within portion 40 or possibly, if it is desirable in a special case, at the bottom, which is easily done e.g. if passage 42 does not extend in a vertical plane obliquely downwardly but obliquely downwardly in a lateral direction in either element 5 or 7, while lower pipe 18 continues straight ahead, in which way a reversal can be attained, which however normally probably is not required. The end openings of pipes 18,19 are, in the same way as is shown in FIG. 4, provided with internal grooves 44 and O-rings or the like 45 introduced in said grooves. Also, in required places possibly screwed plugs 46,47 can be used in order to render possible a chip removal machining operation or the like.

Radiator connection element 8, shown in FIG. 6, is mainly similar in its design to the above-described elements and comprises a shell 48, which accommodates pipes 18,19, the end areas of which, in a way which corresponds to the above-described elements, are provided with internal grooves 49 and O-rings or the like 50 introduced in said grooves. In this way connection elements 2 can be sealingly connected in the two directions, and a longitudinal adjustment can thus be obtained. Starting from below two similar vertical cylindrical cuts 51 are disposed in shell 48, at a distance in a horizontal direction from each other and e.g. having a step-shaped expansion 52 at their lower ends and a similar constriction 53 at their upper ends, from which said cut with its smallest diameter extends outwardly through the upper side of shell 48. In each cut 51 an insert (member) 54 or 55 is introduced. Said inserts have a common principal design, namely a cylindrical body, which essentially fills the respective cuts and has a lower flange 56 and 57 respectively and an upper step-shaped end 58 and 59 respectively as well as insert connection pieces 60 and 61 respectively, which project through the upper cut opening. On said pieces, preferably provided with external threads, suitably nipples 62 can be screwed, which allow, via seals or the like 63, a sealing against said shell and said insert as well as a sealed engagement of said flanges 56,57 against the adjacent portion of said cut, preferably with intermediate seals or the like (not shown). Connection pipes 64 to a radiator 11 can then be connected to nipples 62 by means of nuts 65 in a way known per se.

Inserts 54,55 are provided with transverse openings, which correspond to pipes 18 and 19 respectively. As regards first bore insert 54 suitably there is a full equivalence, while as regards second bore insert 55 a direct connection between the radiator and pipe 18 via a closer casing-shaped passage 66 is intended as regards one of said radiator connections 64. Thus, this is the case with the radiator connection element according to FIG. 6*a*, which is designed for two-pipe (parallel) systems, in which one of said radiator connections 64 is entirely connected to pipe 19, while the other radiator connection 64 is entirely connected to pipe 18, pipe 19 being extended round the closer casing-shaped portion 66, which is shown in FIG. 6*a* and *d*. In order to avoid that casing-shaped portion 66 detrimentally influences the flow through pipe 19 laterally disposed recesses 67 are designed in insert 55, which are shown in FIG. 6*a* and *d*. The material in shell 8 possibly can also be reduced around casing-shaped portion 66, i.e. within the area of upper pipe 19 around each cut 51, if that is required. Said inserts are around their waist suitably provided with circumferential grooves 87 and O-rings or the like 88 introduced into said grooves.

The design according to FIG. 6*b* is used for one-pipe (series) system, two similarly designed inserts 54 suitably being introduced into cuts 51, while the section of pipe 19 and/or possibly pipe 18 between said inserts is provided with a choke element 68, which it is easy to introduce in the respective pipes from either end, which choke element is shaped like a casing, suitably provided with recessed ends and external circumferential O-ring 69, introduced into a groove 70, and suitably in this way simultaneously an advantageous friction locking can be obtained. This choke element has a passage with a reduced diameter and thus the first radiator connection, seen in the flow direction of the heat medium, is subjected to a higher pressure and consequently can function as an inlet, while the second radiator connection, subjected to a lower pressure, functions as an outlet. Of course, it is easily possible to calibrate said choke elements differently, in which way as regards a series of radiator connection elements a choking according to e.g. a falling or rising scale can be obtained. Cuts 51 and/or inserts 54,55 can be provided with rotation—preventing location notches, in order to position the various pipe sections exactly on one line. To prevent a rotation in this way is a method already known per se and thus such notches are not shown in detail.

In FIG. 7 a joint element is shown, generally designated 10, which possibly is needed between two adjacent connection elements. This element is provided with a shell 71 having pipes, grooves and O-ring or the like according to the design illustrated above, and in order to accommodate e.g. longer projecting pipes a distance element 72 having a central recessed bore or the like 73, designed to introduce a mounting screw, not shown, can be used. The material around bore 73 can be extended inwardly in order to form a location notch 74 designed to hold said pipes. The latter may in said joint elements, also as regards joint elements between other module elements 1–10, be surrounded by cover elements 75 having a wall 76, which surrounds said pipes, and an external joint lip 77, which covers said joint elements outwardly.

Finally in FIG. 8 terminal parts 9 are shown, namely one terminal part for an one-pipe-system in FIG. 8*a* and one terminal part for a two-pipe-system in FIG. 8*b*. The difference is that within the terminal part for an one-pipe-system the two pipes 18,19 are connected to each other through an and passage 78, while instead of such a passage a (partition) 79 is used in the terminal part for a two-pipe-system. In the two cases there are provided at the pipe inlets circumferential recessed grooves and O-rings or the like introduced in said grooves. It is apparent, that the two terminal parts and the two designs allow blind terminal branches. The only difference is that in a two-pipe-system already in the first fed radiator the return water enters into the return piping, while a true return piping not starts until in the terminal part as regards a one-pipe-system.

The present invention is not limited to the embodiments described above and shown in the accompanying drawings but can be modified and supplemented in an arbitrary manner within the scope of protection of the present inventive idea and of the following patent claims. All of the components can of course be provided with e.g. a covering shell of some kind of fine wood or of any other arbitrarily selected material and configuration, and possibly quick-locking means designed in a way known per se can be used. Also, it is possible, according to the need, to make the various modules more or less heat-insulating, which has been stated above. The modules advantageously can be provided with at least one extra through cavity in their longitudinal direction, e.g. in the form of a third and a fourth pipe or piping respectively, through which cavities e.g. cooled or heated air can be transported or which can be used for wiring of e.g. electrical, tele- and/or communication wires etc. Such additional cavities only result in a very small additional cost and no extra work whatsoever during the installation work, since the same construction and assembly principle can be used as for the water pipes. Also, in particular cases it is feasible to use an extra cavity for a tap water pipe, the cavity itself being used as a tap water pipe, or a hose, preferably made of a plastic material and inserted into the cavity.

I claim:

1. A heating system for building, using water as a heat transmitting medium, comprising two conduits (18, 19), one of which is a supply conduit and the other of which is a return conduit, and at least one of the two conduits being connected with at least one radiator (11), characterized in that the heating system comprises a plurality of different modular building elements (1–10) interconnectable with one another to form a flow path for the water therethrough, and each building elements (1–10) has a said supply and a said return conduit supported therein disposed adjacent and substantially parallel one another, wherein at least one of the building elements of the heating system is a connection element (8) which connects the at least one radiator (11) to the heating system, the connection element (8) comprises an elongate element carrying a said supply and a said return conduit and having two spaced apart bores (51) extending therethrough at right angles to the two conduits and disposed within a plane defined by the two conduits, a removable bore insert (54, 55) is positioned within each bore (51) and each bore insert having two transverse openings therethrough aligned with said supply and return conduits and interconnects the at least one radiator with a desired one of the two conduits of the connection element, and the bore inserts are removable from their respective bores, said bore inserts (54, 55) comprising either of identical bore inserts, each interconnecting the at least one radiator with the same conduit, provided in the two bores of the connection element (8) so that a series piping system is achieved or dissimilar bore inserts, each interconnecting the at least one radiator with a different one of the two conduits, provided in the two bores of the connection element (8) so that a parallel piping system is achieved.

2. A heating system according to claim 1, wherein one of the building elements (1–10) is a connection element (1) having a shell (13) with two main connection pieces (16, 17) projecting from a rear side (15) thereof in the same direction but at different levels spaced from one another, a said return and a said supply conduits, respectively, extend longitudinally through the connection element and each being connected at a right angle with a different one of the two main connection pieces;

the main connection pieces (16, 17) comprise tubular elements, which extend through transverse bores in the shell (13) of the connection element (1), one end of each main connecting piece (16, 17) is closed and carries a flange (21) which engages a recess (22) on a front side of the shell while the opposite end of each of the main connection pieces extends completely through and out of the transverse bores and carries an external thread engageable by a thread member whereby the main connection pieces can be sealingly connect to the shell with an intermediate seal (80) positioned therebetween.

3. A heating system according to claim 2, wherein a transverse opening (82 and 83 respectively) is located adjacent the closed end of the main connection pieces (16, 17) and the transverse opening of each of the main connection pieces communicates with the conduit (18 or 19) to which the main connection piece is connected, and location means (84) are provided on both the main connection pieces 16, 17) and the connection element (1) for insuring properly alignment of the transversed openings with a desired one of the two conduits.

4. A heating system according to claim 1, wherein at least one of the building elements (1-10) is a connection element (2) having a shell (25) which forms an external housing (26) containing a said supply and a said return conduits (27, 28) therein, opposed ends of the two conduits project outwardly in a longitudinal direction disposed adjacent one another, the two conduits are connected to the shell via bridge portions (29), the shell is provided with means for releasably fastening the connection element (2) to a desired object (81), a cavity is formed between the two conduits and the shell which accommodates an insulating material (31), and the opposed ends of each conduit are provided with a circumferential external bevelling (82).

5. A heating system according to claim 1, wherein at least one of the building elements (1-10) is an inner corner element (32) having two legs (33, 34) connected to one another at a right angle, each leg accommodating a said supply and a said return conduits therein, and end portions of each of the said supply and said return conduits remote from the right angle have a circumferential groove (38) formed therein accommodating a seal element (39).

6. A heating system according to claim 1, wherein at least one of the building elements (1-10) is an outer corner element (35) having two legs (36, 37) connected to one another at a right angle, each leg accommodating a said supply and a said return conduits therein, and end portions of each of the said supply and said return conduits remote from the right angle have a circumferential groove (38) formed therein accommodating a seal element (39).

7. A heating system according to claim 1, wherein at least two of the building element (1-10) are first and second transition element (5, 7), the first transition element comprises a first portion (40) connected to a second portion (41) by a transition section, the first transition element accommodating a said supply and a said return conduits therein, the said supply and said return conduits in the first portion defining a first plane and said supply and said return conduits in the second portion defining a second plane perpendicular to said first plane with the transition section allowing transition of the said supply and said return conduits between the first and second portions, the opposed ends of the two conduits (18, 19) are provided with an internal groove (44) accommodating a sealing element (45), and the second transition element is a mirror image to the first transition element.

8. A heating system according to claim 1, wherein the connection element (8) has a shell (48) and opposed end portions of each of the two conduits are provided with an internal groove accommodating a sealing element (50).

9. A heating system according to claim 8, wherein the bores (51) are each provided with a step-shaped expansion (52) at one end thereof and a step-shaped constriction (53) at the other end thereof which forms a smaller diameter opening in an upper surface of the shell (48), each bore insert essentially fills the respective bore and has a lower flange (56 and 57, respectively) engaging the expansion and an upper step-shaped end (58 and 59, respectively) engaging the constriction and an insert connection piece (60 and 61, respectively) projecting out through the bore, each insert connection piece is provided with an external thread engaged by a nipple (62) which, via seal elements (63), allows a sealed engagement between the connection element and the bore insert.

10. A heating system according to claim 9, wherein a connection element (64) of the at least one radiator (11) is connected to the nipple (62).

11. A heating system according to claim 1, wherein the bore inserts (54, 55) are each provided with at least one transverse opening (85, 86) communicating with one of the two conduits (18, 19) and a central passage extending at least partially through the bore insert along a longitudinal axis defined by the bore insert and the central passage is connected with the transverse opening.

12. A heating system according to claim 1, wherein a first bore insert (54) has two spaced apart transverse openings (85, 86) which are located, when the bore insert is received within the bore, to communicate with the said supply and said return conduits (18, 19), respectively, and the central passage communicates only with the transverse opening communicating with the said supply conduit, whereby when a said first bore insert (54) is positioned in each of the bores (51) of the connection element (8) the series system is achieved.

13. A heat system according to claim 1, wherein a first bore insert (54) has two spaced apart transverse openings (85, 86) which are located, when the bore insert is received within the bore, to communicate with the said supply and said return conduits (18, 19(, respectively, and the central passage communicates only with the transverse opening communicating with the said supply conduit and a second bore insert (55) is only provided with one transverse opening and provides communication between the said return conduit and the central passage but prevents communication between the said supply conduit and the central passage, whereby when the first and second bore inserts are positioned in the respective bores (51) of the connection element (8) the parallel system is achieved.

14. A heat system according to claim 1, wherein a choke element (68) is inserted in the said supply conduit (19) of the connection element (8) of series system, between the two bores.

15. A heating system according to claim 1, wherein at least one of the bores 51 is provided with rotation of preventing locational notches.

16. A heat system according to claim 4, wherein at least one of the building elements (1-10) is a joint element (10) for interconnecting two adjacent connection elements (2), each joint element comprises a shell (71) containing a said supply and a said return conduits (18, 19) and opposed ends of the said supply and said return conduits having an internal groove accommodating a sealing element, the joint element further comprises a distance element (72) having a central recessed bore (73) for accommodating a fastening element for fastening the joint element (10) to a desired object, and the distance element (72) having location notches (74) on an interior surface thereof for locating and retaining the two conduits (27, 28).

17. A heating system according to claim 16, wherein joints between other building elements (1-10) are provided with a cover element (75), having a wall (76) which surrounds the two conduits (27, 28) and an external joint lip (77) which outwardly covers the joint.

18. A heating system according to claim 1, wherein at least one of the building elements (1-10) is a terminal part (9) for the series system which includes an end passage (78) interconnecting end portions of a said supply and a said return conduits (18, 19) with one another within the terminal part, and a circumferential recessed groove accommodating a sealing element is formed in an end of each of the two conduits remote from the end passage.

19. A heat system according to claim 1, wherein at least one of the building elements (1-10) is a terminal part (9) for the parallel system in which end portions of a said supply and a said return conduits (18, 19) supported therein are sealed and separated from one another by a partition (79), and a circumferential recessed groove accommodating a sealing element is formed in an end of each of the conduits remote from the partition.

* * * * *